US009514766B1

(12) United States Patent
Joshi et al.

(10) Patent No.: US 9,514,766 B1
(45) Date of Patent: Dec. 6, 2016

(54) COMPUTATIONALLY EFFICIENT DATA RATE MISMATCH COMPENSATION FOR TELEPHONY CLOCKS

(71) Applicant: Continental Automotive Systems, Inc., Auburn Hills, MI (US)

(72) Inventors: Bijal Joshi, Elk Grove Village, IL (US); Nitu Anil Kumar, Arlington Heights, IL (US)

(73) Assignee: Continental Automotive Systems, Inc., Auburn Hills, MI (US)

( * ) Notice: Subject to any disclaimer, the term of this patent is extended or adjusted under 35 U.S.C. 154(b) by 18 days.

(21) Appl. No.: 14/794,670

(22) Filed: Jul. 8, 2015

(51) Int. Cl.

| | |
|---|---|
| ***G10L 21/00*** | (2013.01) |
| ***G10L 21/0232*** | (2013.01) |
| ***G10L 19/24*** | (2013.01) |
| ***G10L 21/02*** | (2013.01) |

(52) U.S. Cl.
CPC ..... *G10L 21/0232* (2013.01); *G10L 19/24* (2013.01); *G10L 21/0205* (2013.01)

(58) Field of Classification Search
CPC .... G10L 19/0212; G10L 19/022; G10L 19/00; G10L 21/04; G10L 19/12
USPC ..... 704/227, E21.017; 375/377, 355, 372; 370/503, 516
See application file for complete search history.

(56) References Cited

U.S. PATENT DOCUMENTS 6,252,919 B1 6/2001 Lin
7,949,015 B2 5/2011 Miljkovic et al.

FOREIGN PATENT DOCUMENTS

WO 02/052240 A1 7/2002

OTHER PUBLICATIONS

Search Report dated Apr. 15, 2016, from corresponding GB Patent Application No. GB1513624.5.
Stefan Werner, "An Algorithm for Audio Skew Compensation in Low Latency Environments", 2005, 4 pages, vol. 2005.
Tom O'Haver—Professor Emeritus, "A Pragmatic* Introduction to Signal Processing: Smoothing, pp. 11-16", A retirement project, 1997 (Last updated Jun. 25, 2015), Department of Chemistry and Biochemistry, University of Maryland at College Park.
Orion Hodson et al., "Skew Detection and Compensation for Internet Audio Applications", Proceedings of the IEEE International conference on Multimedia and Expo, Jul. 2000, IEEE Computer Society.

*Primary Examiner* — Charlotte M Baker

(57) ABSTRACT

Differing first and second audio signal sample rates from first and second audio signals are matched to each other. If signal sample rates are different, a frame of samples of the first audio signal is duplicated. The duplicate copies are multiplied by a window function and its inverse to produce "windowed frames" first and last samples of which can be deleted or added to increase or decrease a frame rate.

22 Claims, 10 Drawing Sheets

COMPUTATIONALLY EFFICIENT DATA RATE MISMATCH COMPENSATION FOR TELEPHONY CLOCKS

BACKGROUND

When sampling an audio signal for digital transmission, a sample rate is determined by a clock, typically embodied as a quartz crystal oscillator, the output frequency of which can differ from a desired nominal rate for multiple reasons. In telecommunications systems where network access devices have independent clocks, data rate mismatches between two clock rates will inevitably occur. Such differences cause artifacts in an audio signal when it is reconstructed from digital samples. Those artifacts can be manifested as clicks, pops and/or momentary silence, all of which are annoying.

A prior art "brute force" method of simply adding or removing zero samples or repeat samples from a digital signal does not solve the problems created by dissimilar clocks. Adding or removing samples will instead introduce discontinuity in an audio signal and generate audible artifacts (clicks or pops) that will deteriorate the end user experience. Introducing average sample of the surrounding samples still doesn't resolve the audible artifacts completely.

Another prior art method of predicting samples based on historical data may become too much computationally expensive for embedded type applications.

A simple, computationally efficient method of matching different digital sample transmission rates would be an improvement over the prior art.

DETAILED DESCRIPTION

Figure 1:
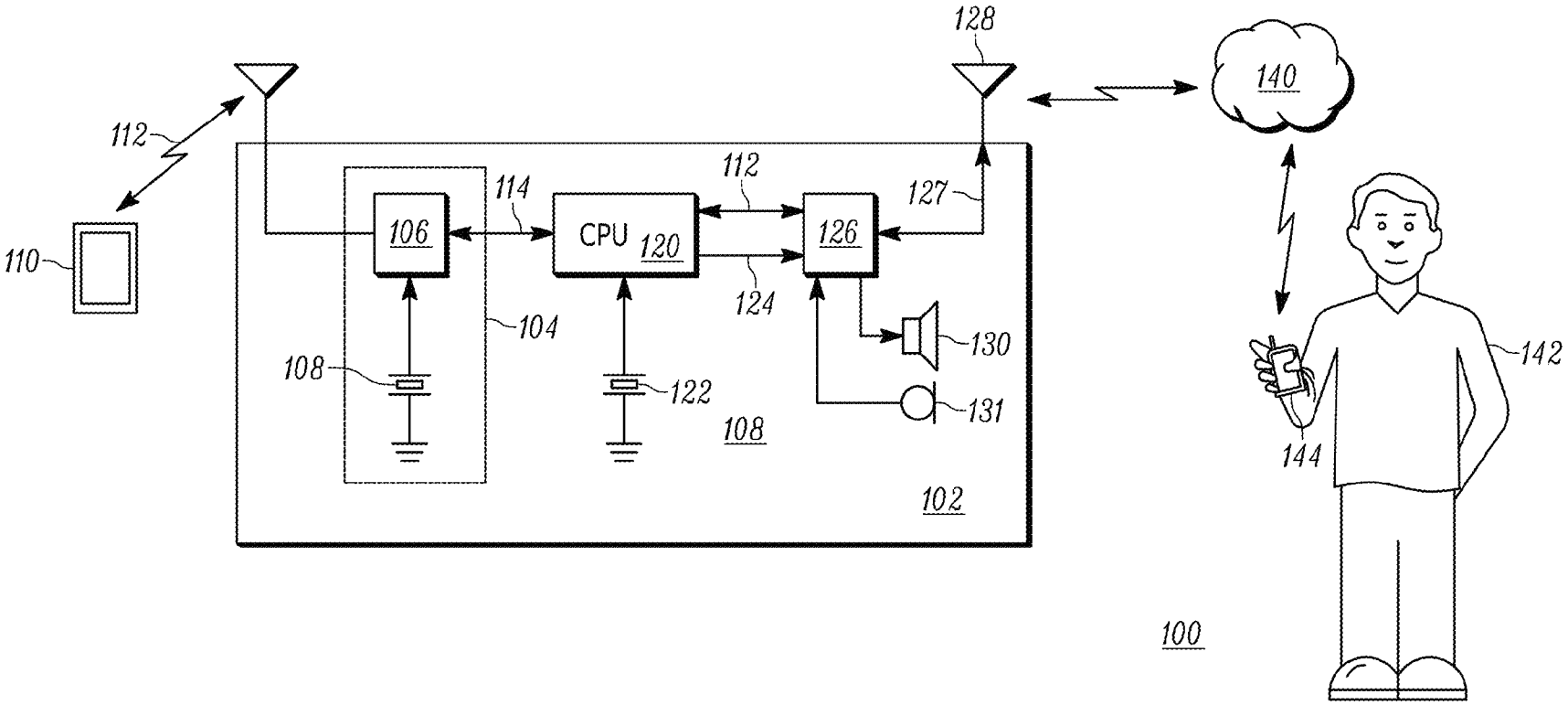
FIG. 1 depicts a telephony system, different components of which can generate pulsed modulation (PCM) voice samples at different rates due to different clock signal frequencies.

FIG. 1 depicts one embodiment of a conventional telephony system 100. The system 100 shown in FIG. 1 comprises a vehicle radio 102, an example of which would be a radio portion of an "infotainment" system for a motor vehicle, not shown.

The radio 102 includes a Bluetooth transceiver 104 having a radio frequency transceiver 106 that receives and transmits Bluetooth signals, from and to respectively, Bluetooth-capable devices to which the transceiver 106 is "paired." The operation of the transceiver 106, including its conversion of audio signals to pulse coded modulation (PCM), is controlled or timed by a timing signal or clock provided to the transceiver 106 by a conventional quartz crystal 108.

As used herein, the term "real time" refers to the actual time during which something takes place.

The Bluetooth transceiver 104 provides PCM samples 114 to and receives PCM samples 114 from a cellular transceiver 108 in the radio 102, in real time. The cellular transceiver 108 includes a central processing unit (CPU) or computer 120. The CPU 120 receives its own timing signal from its own quartz crystal 122, which is also part of the radio 102. The PCM samples 114 provided to and received from the transceiver 108 in real time, are also provided to and received from the CPU 120 in real time.

The PCM samples 114 that the central processing unit 120 receives in real time from the Bluetooth transceiver 104 are sent or forwarded by the CPU 120 to a coder/decoder (CODEC) 126 in real time, at a rate which is determined by the CPU's quartz crystal 122, not the quartz crystal 108 of the Bluetooth transceiver 104. The PCM samples 114 that the central processing unit 120 sends to the Bluetooth transceiver 104 are received by the CPU 120 from the coder/decoder (CODEC) 126 in real time, at the rate determined by the CPU's quartz crystal 122 because the CPU 120 also provides a clock signal 124 to the CODEC. An output signal 127 from the CODEC 126, which can include audio, can be provided to a loudspeaker 130.

Those of ordinary skill in the art know that the actual frequency and stability, of nominally-identical quartz crystals are rarely identical. The actual frequencies output from two crystals having the same nominal frequency will almost always be different. Their frequencies will also differ or shift differently if the two crystals are subjected to different environmental conditions.

In FIG. 1, when the frequencies of the two crystals 108 and 122 are only slightly different, the rate at which PCM samples 114 are sent by the Bluetooth transceiver 104 to the CPU 120 will be different from the rate at which the same PCM samples 112 are transmitted from the CPU 120 to the CODEC 126. Similarly, the rate of samples sent to the Bluetooth transceiver 104 by the CPU 120 will be different.

Regardless of the cause or reason why two crystals 110 and 122 might have different output frequencies, the timing of the stream of PCM samples 114 provided to the CPU 120 from the Bluetooth transceiver 104 that receives timing signals from its own crystal 108 and vice versa, will almost always have a frequency or sample rate that is slightly different from the frequency or sample rate of the PCM samples 112 output from the CPU 120 because the frequency of the crystal 122 for the CPU 120 will be slightly different from the frequency of the Bluetooth transceivers crystal 108.

Differences between the PCM signal sample rates 114, 112 will inevitably produce artifacts, i.e., clicks, pops and similar annoying sounds, in audio that is re-created from the PCM samples. In the system shown in FIG. 1, PCM samples 112 output from the CPU 120, are essentially transmitted from the CODEC 126, to an antenna 128 from which they are routed through a network 140 to the cell phone 144 of a user 142 at a distant location. The PCM samples can also be used to re-create audio that is output from a loudspeaker 130. When the CPU 120 "runs out of" PCM samples to send, as happens when the CPU 120 outputs PCM samples 112 at a rate that is faster than the samples 114 from the Bluetooth transceiver 104 arrive at the CPU 120, the user 142 at the far end, or the person listening to the loudspeaker 130, will hear one or more artifacts in the audio output from the user's cell phone 144.

Those of ordinary skill in the art will recognize that signals sent from a distant cell phone 144 to the radio 102 in a vehicle will also have their own transmission rates. When the two crystals 108 and 122 in FIG. 1 have different frequencies, PCM samples obtained from the CODEC 126 and provided to the CPU 120 for transmission to the Bluetooth transceiver 104 will also be at a different rate than the transceiver 104 can convert those sample samples for transmission to a paired device. A timing frequency mismatch or a skew between the clocks generated from the crystals 108 and 122 will thus cause artifacts or noise in the audio output from cell phone 110 with which the Bluetooth transceiver 104 is paired.

Put simply, the method and apparatus disclosed herein enables digital samples of audio signals to be exchanged between audio devices that process those audio signal samples at different rates. Stated another way, the method and apparatus herein controls the reception and transmission of digital data representing audio signals exchanged between audio devices that process such data at different rates. Paraphrased, the method and apparatus disclosed herein causes one or both audio devices to either shorten or lengthen frames of audio samples that pass between and through them in order to compensate for data rate mismatches.

As used herein, the term "window" refers to a set of coefficients with which corresponding samples in a data record are multiplied so as to more accurately estimate certain properties of the signal from which the samples were obtained. Generally the coefficient values increase smoothly.

A "window function" is a mathematical function that is zero-valued outside of a chosen interval. By way of example, a function that is a single value inside the interval and zero elsewhere is called a rectangular window, which also describes the shape of its graphical representation. A "triangular" window function will have values that increase gradually across an interval and which are zero outside the interval.

When multiple PCM samples comprising a frame of samples is multiplied by a triangular window function having an interval time that is equal to the time length of the frame, and which has an initial value of zero at the beginning of the interval and a final value of one at the end of the interval, the product of the window function and the frame of PCM samples will be an adjusted or "windowed" frame of PCM samples, the values of which increase gradually from zero. The value or the first sample of the windowed frame will be zero; the value of the last sample of the PCM frame, which is multiplied by one, will be unchanged.

Figure 2A:
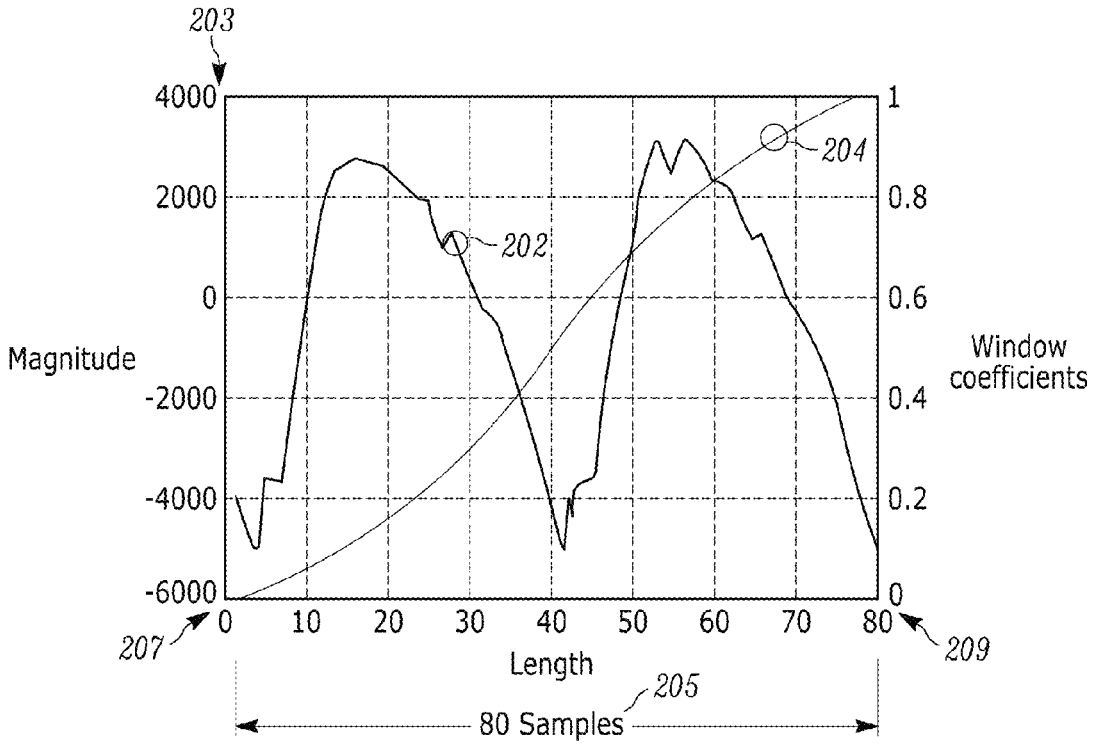
FIG. 2A is a graph of the values of eighty, pulse coded modulation (PCM) samples of an audio signal, and which comprise a frame of samples, as well as a graph of a gradually increasing window function.

FIG. 2A is a graph 202 of amplitudes 203 of eighty (80) PCM samples comprising a first audio signal "frame" 205, such as a frame of PCM audio signals output from either the Bluetooth transceiver 104 to the CPU 120, or the PCM audio signal output from the CPU 120 to the Bluetooth transceiver 104. The frame 205 thus comprises eighty (80) discrete samples. The samples are separated from each other by $1/8000^{th}$ of a second. The nominal time duration or "width" of the frame 205 is thus about 10 milliseconds. The graph 202 thus shows how the amplitudes of the samples of an audio signal can vary over very short periods of time.

FIG. 2A also depicts a graph of a gradually increasing window function. The graph of the window function is identified by reference numeral 204. The window function 204 shown in FIG. 2A.

At the beginning 207 of the frame of samples 205, the window function 204 has a starting value of zero (0.0). At the terminus or opposite end 209 of the frame of samples 205, the window function 204 has an ending value of 1.0.

For every PCM sample between the beginning of the frame 207 and the end of the frame 209, the window function 204 has a corresponding value, which increases continuously between the beginning and end of the frame 205, i.e., gradually increasing from zero to one, across the time duration or "width" of the frame 205.

Figure 2B:
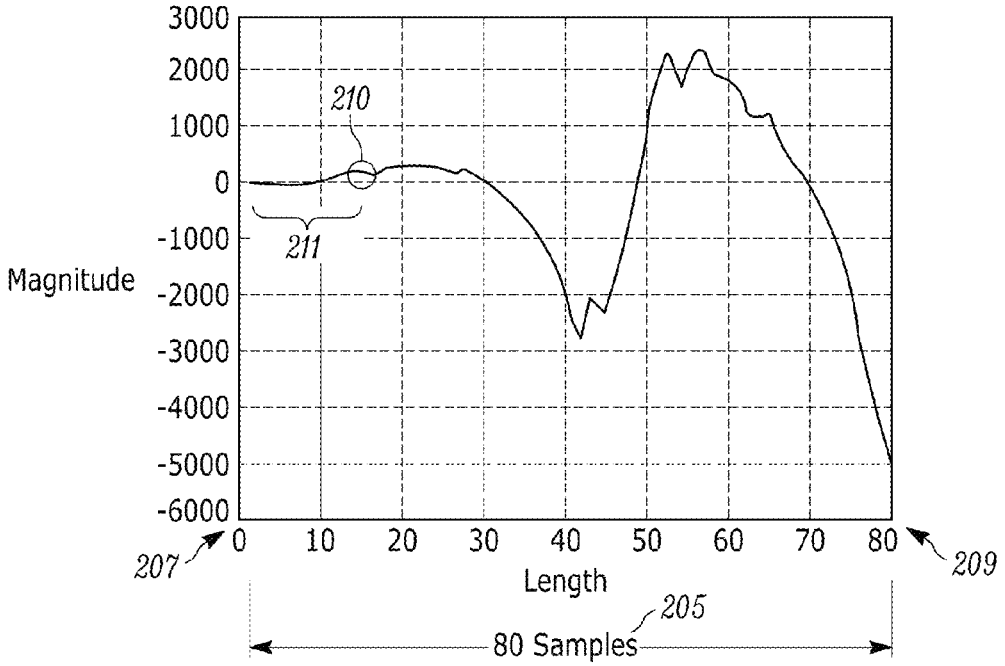
FIG. 2B is a graph of a first windowed frame of samples, namely, the values of the eighty, PCM samples shown in FIG. 2A multiplied by contemporaneous values of the gradually increasing window function shown in FIG. 2A.

FIG. 2B is a graph or plot 210 of the multiplication of every PCM sample depicted in FIG. 2A by the value of the gradually increasing window function 204 at each PCM sample's time in the frame 205.

As FIG. 2B shows, the multiplication of the gradually increasing window function 204 by a value of a corresponding PCM sample to essentially equal to zero for the first eight-to ten samples (211) of the frame 205. As the value of the gradually increasing window function 204 increases from zero, however, the shape of the graph 210 of the product of the two functions begins to resemble the shape of the graph 202 of the samples shown in FIG. 2A.

Figure 2C:
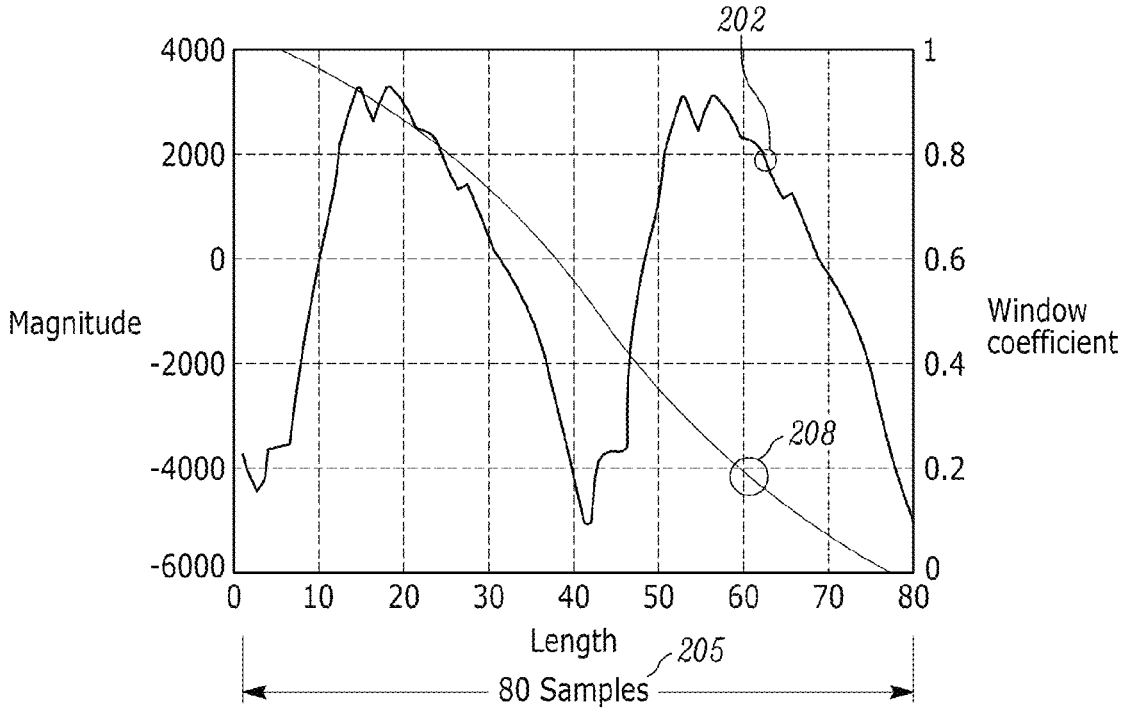
FIG. 2C is a graph of the eighty, pulse coded modulation (PCM) samples of the same audio signal shown in FIG. 2A, and a graph of a gradually decreasing window function.
Figure 2D:
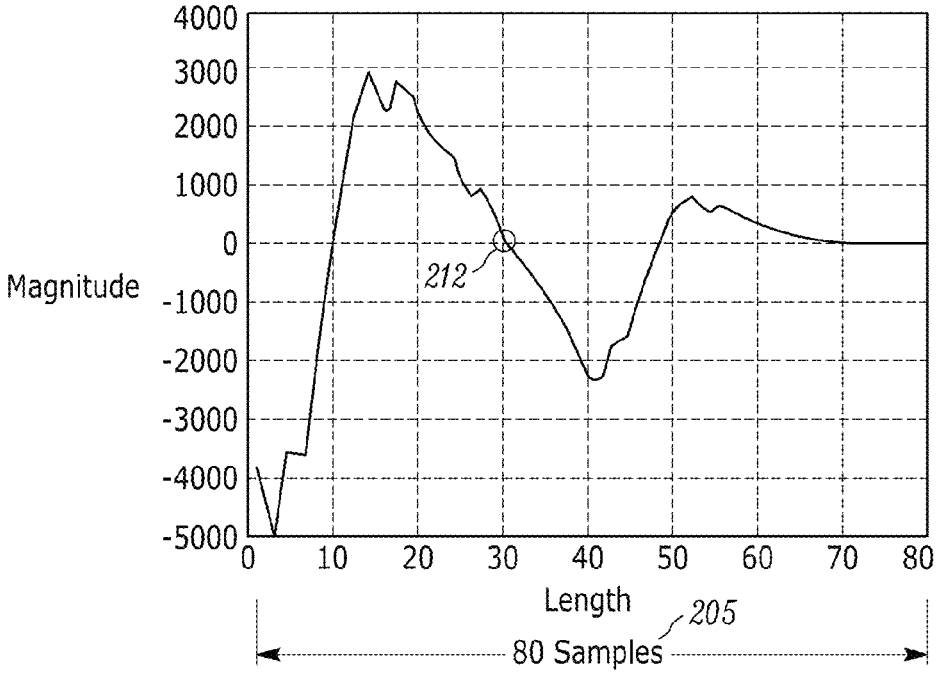
FIG. 2D is a graph a second windowed frame of samples, namely the values of the eighty, PCM samples shown in FIG. 2C multiplied by contemporaneous values of the gradually decreasing window function shown in FIG. 2C.

FIG. 2C depicts the same graph 202 of the same eighty (80) samples shown in FIG. 2A and a graph 208 of the inverse of the window function 204 shown in FIG. 2A. FIG. 2C thus depicts a gradually decreasing window function 208. FIG. 2D depicts a graph or plot 212 of the multiplication of the eighty samples of FIG. 2C by the decreasing window function 208 shown in FIG. 2C.

A comparison of the graph 210 shown in FIG. 2B to the graph 212 shown in FIG. 2D shows that two graphs 210, 212 are approximately mirror images of each other. When the two graphs 210, 212 are added to each other, their sum will virtually re-create the original graph 202 of the samples shown in FIGS. 2A and 2C. Stated another way, the net effect of multiplying a frame of samples 205 by a gradually-increasing window function to produce a first windowed frame 210, and multiplying a copy of the same frame by an inverse of the gradually-increasing window function to produce a second windowed frame 212 and adding the two windowed frames 210, 212 together essentially results in the original frame 202 being re-created.

A frame rate can be effectively reduced, and mismatched data rates of two different communications devices compensated for, by controlling at least one of two communicating devices, e.g., the Bluetooth transceiver 104 and the CPU 120 or, the CPU 120 and the Bluetooth transceiver 104, in order to remove a sample from windowed frames 210, 212, before the windowed frames 210, 212 are added to each other. Similarly, a frame rate can be effectively increased, and mismatched data rates compensated for, by controlling one of the devices to add a sample to two windowed frames, before the windowed frames are added to each other.

In a preferred embodiment, a frame rate is reduced by removing the first sample from a copy of the windowed frame generated by multiplying a frame of samples 205 by a gradually increasing window function 210 and, removing the last sample from the copy of the windowed frame created by multiplying the same frame of samples 205 by a gradually decreasing window function 212. The value of the increasing window function 204 ranges from zero (0.0) to one (1.0). The value of the decreasing window function 208 ranges from one (1.0) to zero (0.0). The increasing and decreasing window functions are thus inverses of each other.

Figure 3A:
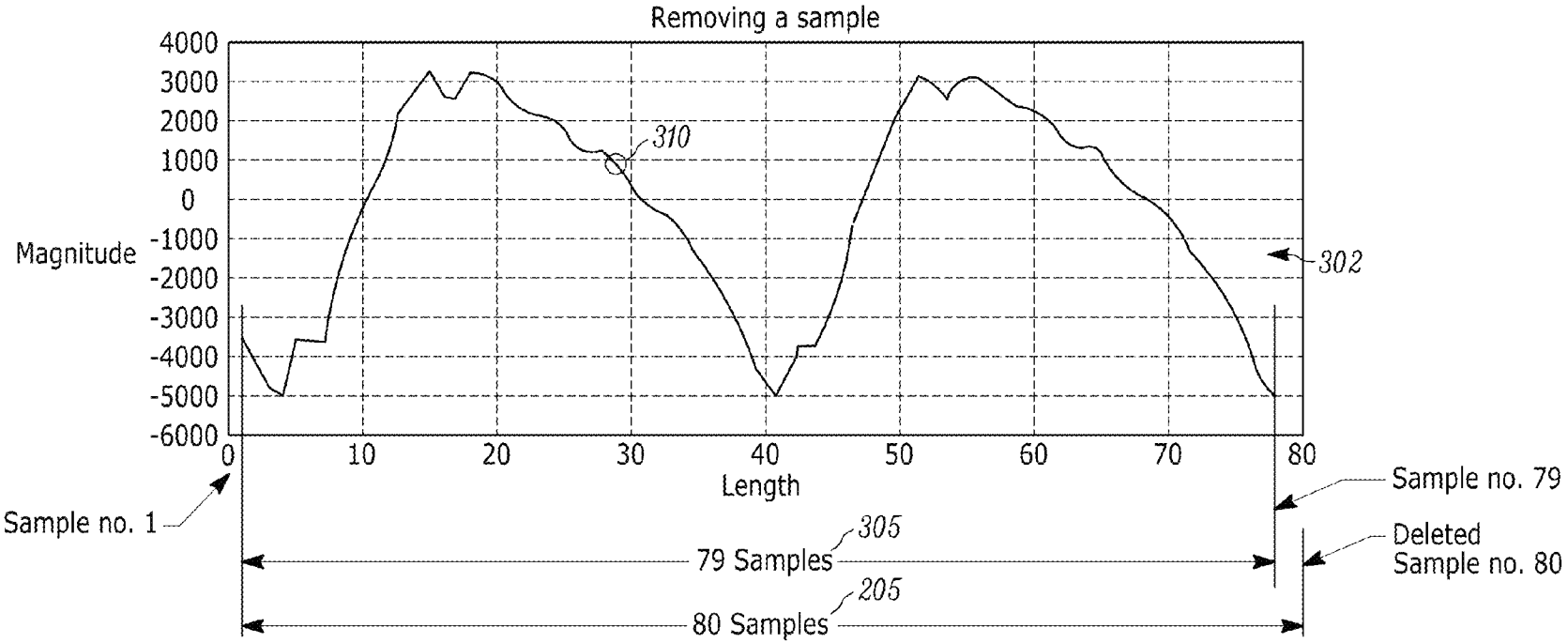
FIG. 3A is a graph of the sum of two windowed frames, after removing the last sample, i.e., sample no. 80, from a single frame.
Figure 3B:
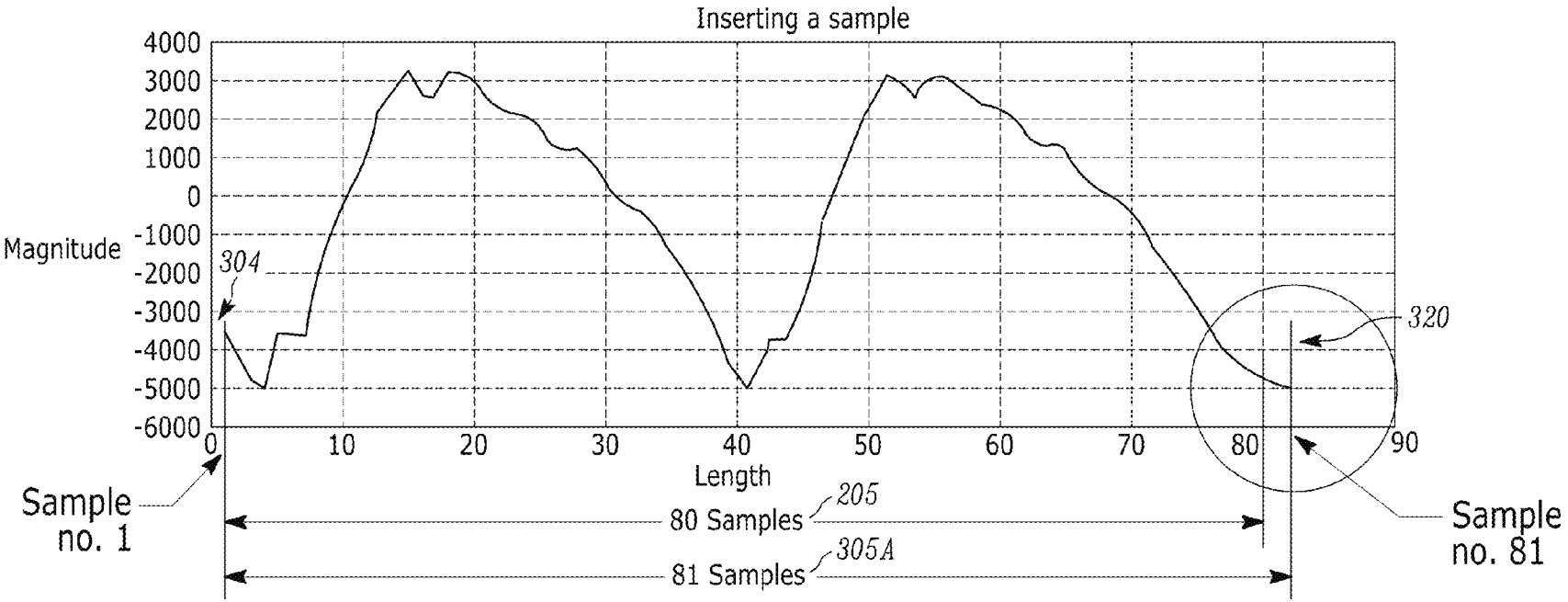
FIG. 3B is a graph of the sum of two windowed frames, after adding one new final or last sample, sample no. 81, to a frame.

FIG. 3A is a graph 310 of the frame of PCM samples 205 depicted in FIG. 2A and FIG. 2C but with one sample deleted. FIG. 3B is a graph of the frame of PCM samples 205 depicted in FIGS. 2A and 2C with a new sample inserted.

With regard to FIG. 3A, in the preferred embodiment, in order to decrease a frame rate, the first sample of the copy of the frame 205 that is multiplied by the gradually increasing window function (the "first windowed frame"), is deleted or removed, as is the last sample of the copy of the frame multiplied by the gradually decreasing window function (the "second windowed frame"). When the two windowed frames are added together, the result is a shortened frame 305 of seventy-nine (79) PCM samples but evenly spaced apart from each other over the same length of time as was the original eighty-sample frame.

In FIG. 3A, the samples are numbered from two (2) through eighty (80) as shown in FIG. 3A. The frame 205 of FIGS. 2A and 2C thus becomes a reduced-length frame 305, i.e., an "adjusted" or "modified" frame 305, the length of which is seventy-nine (79) samples, each of which is separated from the others by about $1/8000^{th}$ of a second. The seventy-nine frames are thus sent in the same nominal time period of about 10 ms. The frame rate is thus reduced.

As shown in FIG. 3B, increasing a frame rate is accomplished by adding a new first sample to a first copy of the first windowed frame and adding a new last sample to the second copy of the second windowed frame. The sample that is added has a value equal to 0.0. When the two windowed, 81-sample frames are added to each other, a new, 81-sample frame 305A, as shown in FIG. 3B, increases a frame rate without distorting the original content of the audio signal from which the original, 80-sample frame was obtained.

Figure 4A:
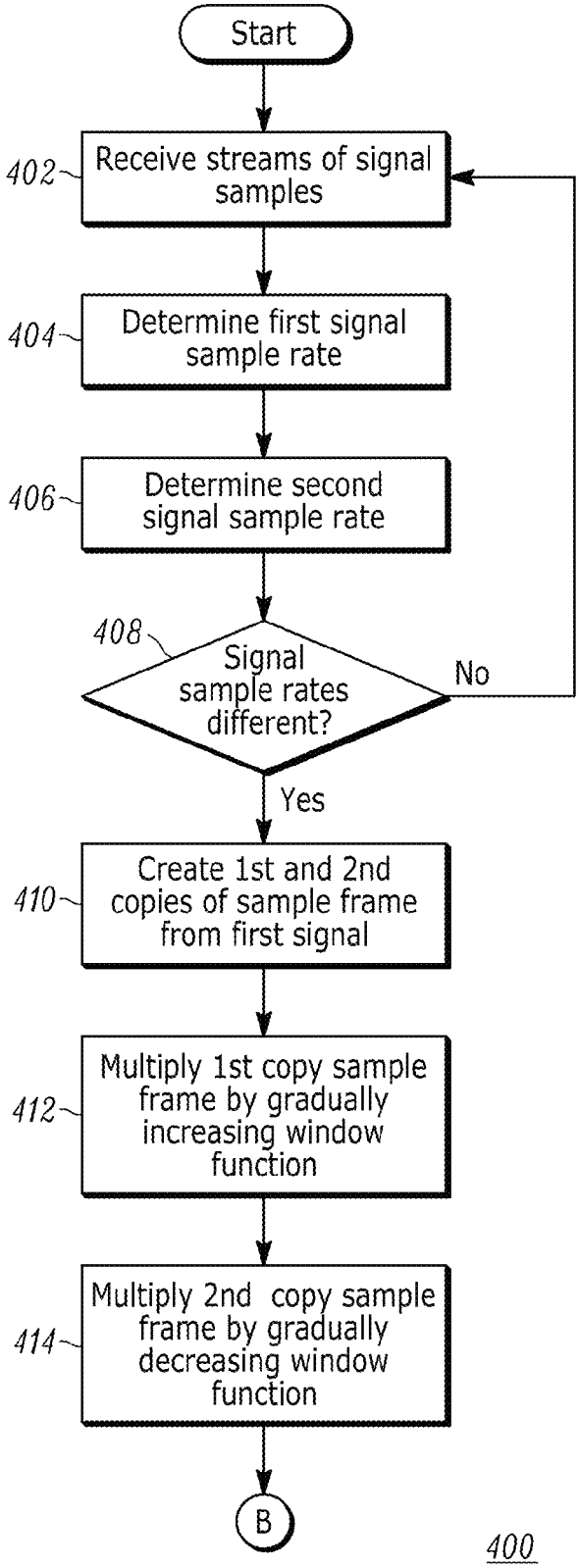
FIGS. 4A and 4B depict steps of a method of matching different audio signal sample rates.
Figure 4B:
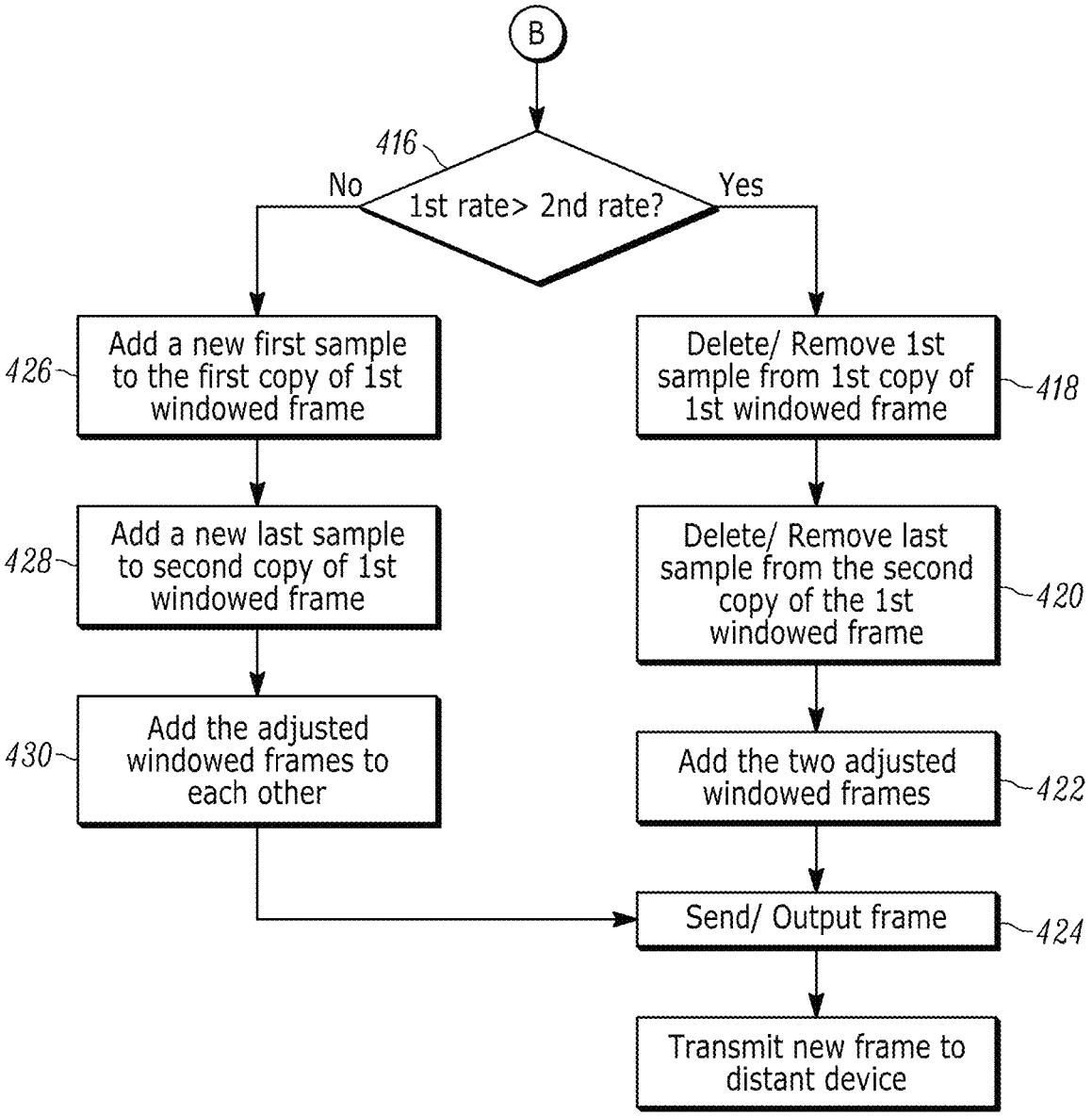

FIGS. 4A and 4B depict steps of a method 400 for matching a first audio signal sample rate to a second audio signal sample rate, when the sample rates are different from each other. As a first step 402, a stream of audio signal PCM samples is received, such as the PCM samples received by the cellular telephone 108 from a Bluetooth transceiver 104. In such an embodiment, the sample rate of the stream 116 from the Bluetooth transceiver 104 is compared to the frame rate or sample rate of the stream of samples provided to the CODEC 126 from the CPU 120. Steps 404 and 406 thus depict determinations of first and second signal sample rates.

At step 408, a determination is made whether the first and second signal sample rates are different from each other. If the rates are the same, there is no need to make adjustments to the signal sample rates.

If at step 408, the two signal sample rates are determined to be different, the method 400 proceeds to step 410 where a frame of samples from one of the signals, e.g., the samples of a frame from the Bluetooth transceiver 104, is copied, producing two duplicate frames of samples from the same signal. At step 412, one of the copies of the frame created at step 410 is multiplied by a gradually increasing window function. Each sample of the frame of samples is multiplied by a numeric value of the gradually increasing window function at the "location" in the frame for the sample to be multiplied. By way of example, the value of the window function for the first sample of the frame is by zero. The value of the window function for the last sample of the frame is zero. The first and last samples the frame are thus multiplied by zero and one respectively. The window function can be linear, non-linear, or sigmoid, but preferably has values that vary continuously or at least nearly continuously between 0.0 and 1.0.

At step 414, the second copy of the frame of the audio signal is multiplied by a mirror image or inverse of the gradually increasing window function. The second copy is thus multiplied by a gradually decreasing window function. Its initial value is 0.0; its final value is 1.0.

At step 416, in FIG. 4B, the method 400 proceeds in one of two different paths or directions. If the first frame rate was greater than the second frame rate, the frame rate of the first audio signal needs to be slowed or reduced. A sample can be removed from one or more frames.

As stated above, a frame rate can be effectively reduced by eliminating one of the samples in a frame of samples. At step 418, the first sample from the first copy of the first windowed frame is deleted. For a frame that was originally 80 samples, after the execution of step 418, that frame will have only 79 samples. At step 420, the last sample from the second copy of the first window frame is also deleted. That second copy of the same frame will thus have 79 samples.

At step 422, the two "adjusted" frames are added to each other. And, as set forth above, the arithmetic addition of two windowed frames, one of which was windowed by an inverse function of the other, results in a re-creation of essentially the original frame, i.e., an approximate replication of the original frame, but after step 422, the number of PCM samples in the original frame will have been reduced by 1 sample leaving seventy nine samples, samples s 2-80. At step 424, the frame, reduced by 1 sample, is transmitted to a radio transceiver, loudspeaker or other communications device configured to create or reconstruct audible sound from PCM samples, an example of which is depicted in FIG. 1.

Referring again to step 416, if the first frame rate is not greater than the second frame rate, the first frame rate is necessarily less than the second frame rate due to the determination made at step 408 that the two frame rates are different. The first frame rate thus needs to be increased and can be increased by adding a sample to the frame.

At step 426, a new, first sample is added to the windowed frame created by multiplying a frame of samples by a gradually increasing window function. The first windowed frame will thereafter have eighty-one (81) samples instead of the original eighty (80) samples.

At step 428 a new last sample is added to the windowed frame created by multiplying the second copy of the frame of samples by a gradually decreasing window function. The second windowed frame will thus have 81 samples.

The two new samples are preferably the same value and preferably zero. When the two windowed frames are added together at step 430, the resultant frame will have 81 samples instead of 80.

Figure 5:
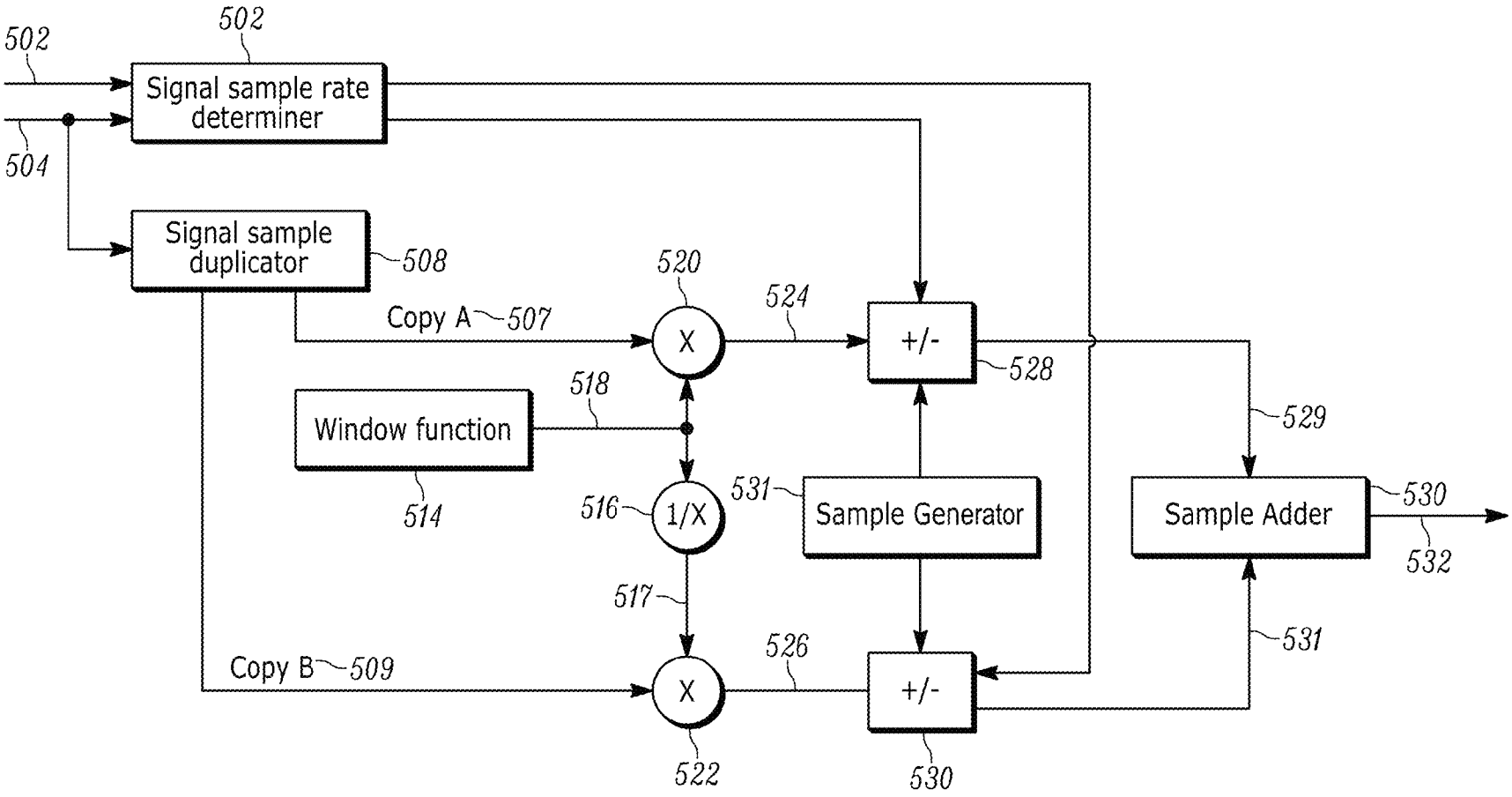
FIG. 5 depicts a first embodiment of an apparatus for matching different audio signal sample rates.
Figure 6:
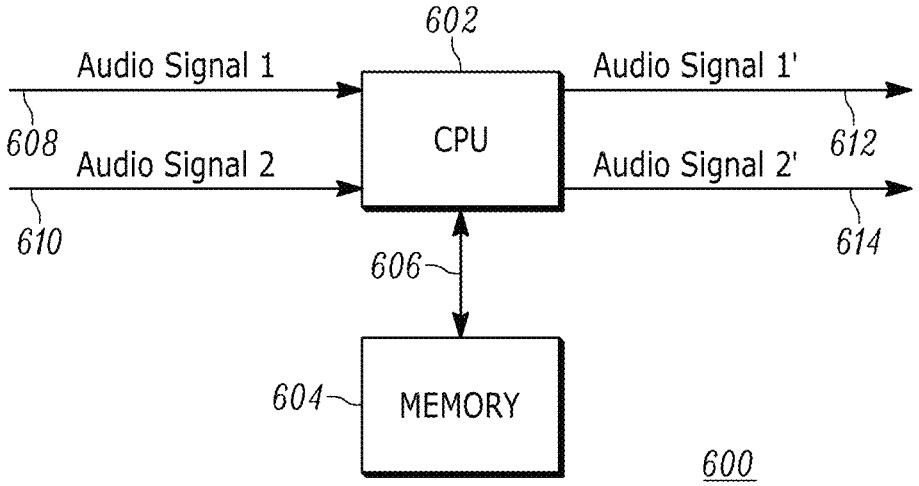
FIG. 6 depicts a second and preferred embodiment of an apparatus for matching different audio signal sample rates.

FIG. 5 depicts a first embodiment of an apparatus 500 for matching different signal sample rates between first and second audio signals. The apparatus shown in FIG. 5 performs the steps recited or disclosed in FIGS. 4A and 4B. In the preferred embodiment, the apparatus depicted in FIG. 5 can be embodied as separate combinational and sequential logic circuits or as shown in FIG. 6, as a processor that executes stored program instructions.

In FIG. 5, a signal sample rate determiner 502 receives two input signals 504 and 506 and determines whether the signal sample rates of the two signals are the same and if not, which of them is greater than the other. Such a rate determiner 502 can be implemented using two counters and a digital comparator.

If the signal sample rates are determined to be different from each other, a signal sample duplicator 508 receives a frame of samples from one of the signals and duplicates them into two identical copies, copy A, 507 and copy B, 509 as shown. Otherwise, the sample rates are identical. Clock rate compensation is not required.

A window function generator 514, implemented perhaps as an operational amplifier configured to act as an integrator, creates a gradually increasing window function 518. Examples of usable window functions are linear functions that ramp continuously from the value of 0.0 to 1.0 over a frame period, non-linear functions that increase gradually from 0.0 to 1.0 over the same frame duration or a sigmoid-type function which increases gradually from 0.0 to 1.0 over the frame duration. Alternate embodiments of the window function generator 514 create window functions that ramp continuously from a non-zero value to a value slightly greater and/or slightly less than 1.0.

The output of the window function generator 518 is itself provided to a multiplier 520. A window function inverter 516 also receives the output 518 of the window function generator 514 and provides an inverse of the window function to a second multiplier 521. The multiplier can be readily implemented using one or more prior art shift registers or adders.

As shown in FIG. 5, the first copy 507 of the signal frame, i.e., the frame of samples, is multiplied by the first window function 518. The result of such a multiplication is a first windowed frame 524. The second copy 509 of the signal frame is provided to the second multiplier 522 which multiplies each sample of the frame by an inverse value 517 of the window function 514 to provide a second windowed frame 526. The outputs 524 and 526 of the two multipliers are thus first and second windowed frames of data 524, 526, each of which is input to a corresponding adder/subtractor 528 and 530.

Depending upon which sample rate was determined to be fastest, the signal rate sample determiner 502 instructs the adders and subtractors 528 and 530 to either add or subtract a first sample to, or from, the first windowed frame 524. Similarly, the signal rate determiner 502 controls the second adder/subtractor to subtract or add a last sample to, or from, the second windowed frame 526. The outputs from the adders and subtractors 528, 530 are "adjusted window frames" 529 and 531.

An adder 530 receives the adjusted windowed frames 529, 531, adds them together and provides an increased or decreased frame rate signal 532, the rate of which is essentially the same or identical to one of the first and second frame rates provided to the signal frame rate determiner 502.

FIG. 6 depicts a second and preferred embodiment 600 of an apparatus for matching a first audio signal sample rate to a second audio signal sample rate. In FIG. 6, the apparatus 600 comprises a processor or CPU 602, which is coupled to a memory device 604 in which program instructions are stored for the CPU 602. Those instructions are transferred to and from the CPU via a conventional bus 606.

The instructions stored in the memory, when executed by the CPU 602 perform the steps described above and depicted in FIGS. 4A and 4B. Put simply, a first input audio signal 608 having a first frame rate is compared to a second audio signal 610 which may have the same or a different frame rate. Upon a determination that the frames are different, the CPU 602 performs the steps and operations described above. The CPU outputs either a decreased or increased first audio signal 612 or an increased or decreased frame rate second audio signal 614.

Figure 7A:
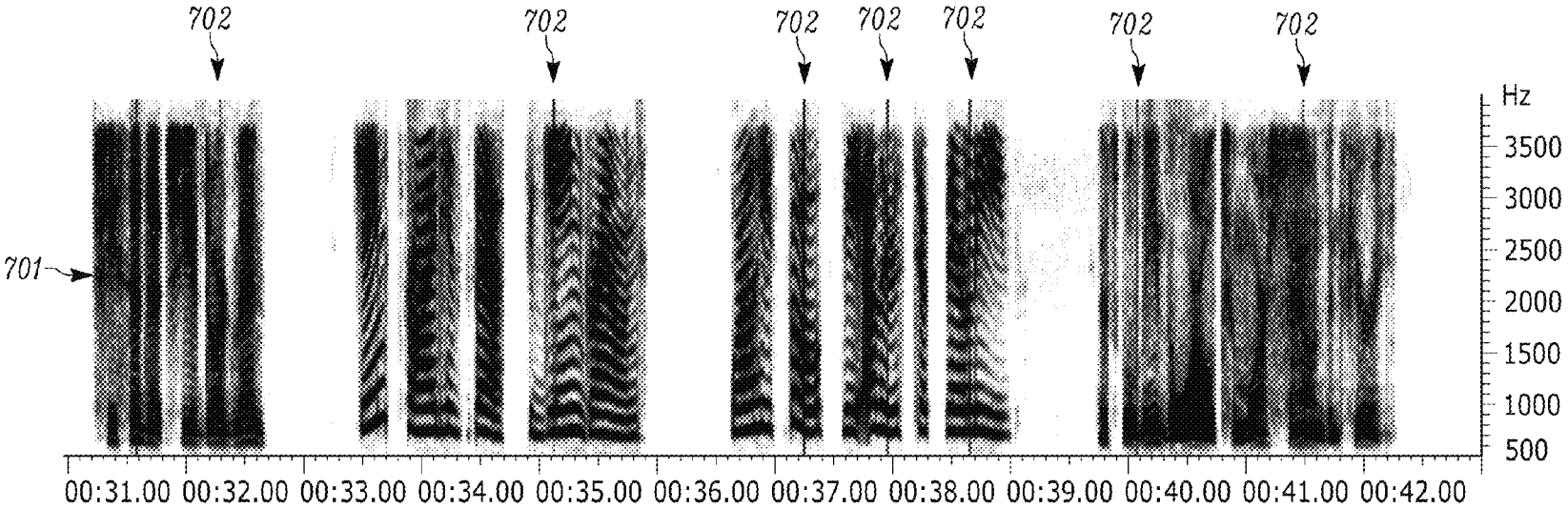
FIG. 7A depicts spectral representations of speech with brute force sample correction.
Figure 7B:
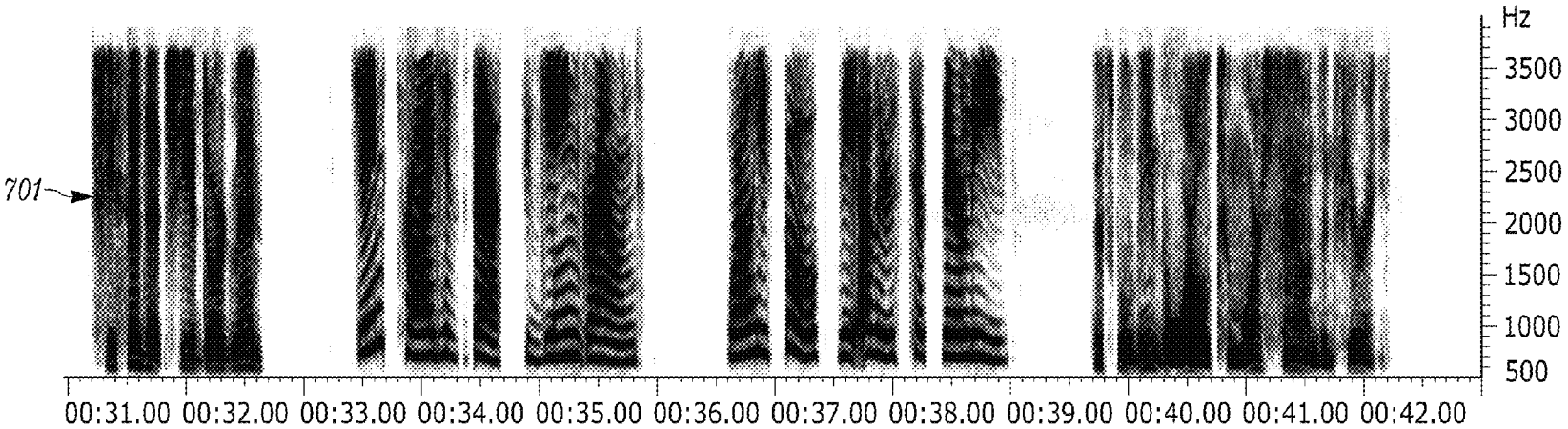
FIG. 7B depicts spectral representations of speech with proposed sample correction method

FIGS. 7A and 7B shows plots of the same spectral representations of speech 701 over time. In FIG. 7A, short-duration "spikes" in the speech 701 are identified by reference numeral 702. The spikes 702 produce audible clicks and pops in the audio and are caused by the aforementioned prior art brute force methods of compensating for clock skew, an example of which is inserting "zeroes" into a frame of speech samples.

FIG. 7B shows the same audio signal 701 shown in FIG. 7A but the audio spectrum 701 of FIG. 7B has clock skew compensation provided using the method disclosed herein. The noise spikes 702 visible in FIG. 7A are missing from the spectrum 701 shown in FIG. 7B. The clicks and pops are missing; the audio fidelity is improved.

Referring again to FIG. 1, those of ordinary skill in the art will recognize that when a telephony device such as the Bluetooth transceiver 104 of FIG. 1 has a frame rate that is different from the frame rate of a cell phone 110 or CPU 120 to which it is operably coupled, the frame rates of audio signal samples flowing between them will require compensation, i.e., the frame rate of audio signal samples transmitted to and from the Bluetooth transceiver 104 and the frame rate of audio signal samples received by and sent to the Bluetooth transceiver 104 will require compensation. Similarly, the frame rate of audio signal samples transmitted from a cell phone 110 or CPU 120 and the frame rate of audio signal samples received by them will require the same amount of compensation. Two dissimilar frame rates can be matched or compensated for, using the method and apparatus described above.

In various embodiments, audio signals with a first frame rate can be obtained from an audio signal carried on a USB communications link as well as a voice-over Internet Protocol link (VOIP). Both those media are well known to those of ordinary skill in the telecommunications art. Since they are well known, depictions of them per se are therefore omitted in the interest of brevity.

The foregoing description is for purposes of illustration. The true scope of the invention is set forth in the following claims.

What is claimed is:

1. A method of matching a first audio signal sample rate of a first audio signal, to a second audio signal sample rate of a second audio signal, the first and second audio signal sample rates being different from each other, the method comprising:

determine whether the first signal sample rate is greater than or less than the second signal sample rate;

if signal sample rates are different, create copies of a first frame of samples of the first audio signal then:

multiply a first copy of the frame of samples of the first audio signal by a first gradually increasing window function to provide a first windowed frame;

multiply a second copy of the frame of samples of the first audio signal by a second gradually decreasing window function to provide a second windowed frame;

if the first signal sample rate was determined to be greater than the second signal sample rate:

remove a first sample from the first windowed frame;

remove a last sample from the second windowed frame; and sum the first and second windowed frames to create a reduced-sample frame;

if the first signal sample rate was determined to be less than the second signal sample rate:

add a new first sample to the first windowed frame;

add a new last sample to the second windowed frame;

sum the first and second windowed frames to create an increased-sample frame;

and;

transmit either the reduced-sample frame or the increased-sample frame to a communications device, configured to create an audible audio signal from audio signal samples.

2. The method of claim 1, wherein the first audio signal is received from a telecommunications device and wherein the second audio signal is transmitted to the telecommunications device.

3. The method of claim 1, wherein the first audio signal is transmitted to a telecommunications device and wherein the second audio signal is received from the telecommunications device.

4. The method of claim 1, wherein the first gradually increasing window function and the second gradually decreasing window function are inverses of each other.

5. The method of claim 1, wherein samples that are added to frames and samples that are removed from frames have values, which are substantially the same.

6. The method of claim 1, wherein samples that are added to frames and samples that are removed from frames have values, which are substantially equal to zero.

7. The method of claim 2, wherein the first gradually increasing window function and the second gradually decreasing window function are sigmoid functions.

8. The method of claim 2, wherein the first gradually increasing window function and the second gradually decreasing window function are linear functions.

9. The method of claim 2, wherein the first gradually increasing window function and the second gradually decreasing window function are non-linear functions.

10. The method of claim 1, wherein at least one of the first audio signal sampling rate and second audio signal sampling rate, is obtained from an audio signal carried on a Bluetooth communications link.

11. The method of claim 1, wherein at least one of the first audio signal sampling rate and second audio signal sampling rate, is obtained from an audio signal carried on a cellular telephone communications link.

12. The method of claim 1, wherein at least one of the first audio signal sampling rate and second audio signal sampling rate, is obtained from an audio signal carried on a USB communications link.

13. The method of claim 1, wherein at least one of the first audio signal sampling rate and second audio signal sampling rate, is obtained from an audio signal carried on a Voice Over Internet Protocol (VOIP) communications link.

14. An apparatus for matching a first audio signal sample rate of a first audio signal, to a second audio signal sample rate of a second audio signal, the first and second audio signal sample rates being different from each other, the apparatus comprising:

a determiner, configured to determine whether the first signal sample rate is greater than or less than the second signal sample rate;

a duplicator coupled to the determiner and configured to create copies of a first frame of samples of the first audio signal;

a window function generator, configured to generate a gradually increasing window function;

a divider coupled to the window function generator and configured to generate a gradually decreasing window function;

a first multiplier coupled to the window function generator and to the duplicator, the first multiplier configured to multiply a first copy of the frame of samples of the first audio signal by the gradually increasing window function to provide a first windowed frame;

a second multiplier coupled to the divider and to the duplicator, the second multiplier configured to multiply a second copy of the frame of samples of the first audio signal by the gradually decreasing window function to provide a second windowed frame;

and, a sample subtractor/generator, configured to add and remove a first sample from the first windowed frame and add and remove a last sample from the second windowed frame; and a frame adder, configured to combine signals output from the sample subtractor/generator.

15. The apparatus of claim 14, wherein the first audio signal is a signal received from a telecommunications device and wherein the second audio signal is a signal transmitted to the telecommunications device.

16. The apparatus of claim 14, wherein the first audio signal is a signal transmitted to a telecommunications device and wherein the second audio signal is a signal received from the telecommunications device.

17. An apparatus for matching a first audio signal sample rate of a first audio signal, to a second audio signal sample rate of a second audio signal, the first and second audio signal sample rates being different from each other, the apparatus comprising:

first and second communications devices, the first and second communications device generating first and second audio signal samples having the corresponding first and second signal sample rates;

a processor coupled to the first and second communications devices; and a memory device coupled to the processor by a bus, the memory device storing executable instructions for the processor which when executed cause the processor to:

determine whether the first signal sample rate is greater than or less than the second signal sample rate;

if signal sample rates are different, create copies of a first frame of samples of the first audio signal the executable instructions causing the processor to then:

multiply a first copy of the frame of samples of the first audio signal by a first gradually increasing window function to provide a first windowed frame;

multiply a second copy of the frame of samples of the first audio signal by a second gradually decreasing window function to provide a second windowed frame;

if the first signal sample rate was determined to be greater than the second signal sample rate, the executable instructions causing the processor to:

(1) remove a first sample from the first windowed frame;

(2) remove a last sample from the second windowed frame; and (3) sum the first and second windowed frames to create a reduced-sample frame;

if the first signal sample rate was determined to be less than the second signal sample rate, the executable instructions causing the processor to:

(1) add a new first sample to the first windowed frame;

(2) add a new last sample to the second windowed frame;

(3) add the first and second windowed frames to each other to create an increased-sample frame;

and;

transmit either the reduced-sample frame or the increased-sample frame to a communications device configured to create an audible audio signal from audio signal samples.

18. The apparatus of claim 17, wherein the first audio signal is a signal received from a telecommunications device and wherein the second audio signal is a signal transmitted to the telecommunications device.

19. The apparatus of claim 17, wherein the first audio signal is a signal transmitted to a telecommunications device and wherein the second audio signal is a signal received from the telecommunications device.

20. The apparatus of claim 17, wherein the first communications device is a Bluetooth headset and wherein the second communications device is a cellular telephone.

21. The apparatus of claim 17, wherein the first communications device is a USB communications link.

22. The apparatus of claim 17, wherein the first communications device is a VOIP communications link.

* * * * *